US006866401B2

(12) United States Patent
Sommers et al.

(10) Patent No.: US 6,866,401 B2
(45) Date of Patent: Mar. 15, 2005

(54) ZOOMABLE SPOT MODULE

(75) Inventors: Mathew Sommers, Sagamore Hills, OH (US); James T. Petroski, Parma, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/683,395

(22) Filed: Dec. 21, 2001

(65) Prior Publication Data

US 2003/0117797 A1 Jun. 26, 2003

(51) Int. Cl.[7] ..... F21V 21/26

(52) U.S. Cl. ..... 362/268; 362/269; 362/270; 362/232; 362/237; 362/238; 362/240; 362/800; 362/169; 362/170; 362/275

(58) Field of Search ..... 362/268, 269, 362/270, 273, 232, 237, 238, 239, 240, 800, 804, 294, 373, 169, 170, 171, 275

(56) References Cited

U.S. PATENT DOCUMENTS

| | | | | | |
|---|---|---|---|---|---|
| 3,302,016 | A | * | 1/1967 | Larraburu | 362/268 |
| 5,083,253 | A | * | 1/1992 | Hahnel | 362/306 |
| 5,580,163 | A | * | 12/1996 | Johnson, II | 362/285 |
| 6,069,447 | A | * | 5/2000 | Vilanilam et al. | 315/56 |
| 6,414,801 | B1 | * | 7/2002 | Roller | 359/726 |

* cited by examiner

*Primary Examiner*—Sandra O'Shea
*Assistant Examiner*—Bertrand Zeade
(74) *Attorney, Agent, or Firm*—Fay, Sharpe, Fagan, Minnich & McKee, LLP

(57) ABSTRACT

A lamp (10, 30, 80) includes an LED module (16, 36, 86) having at least one LED (12, 32, 82) arranged on a substrate (14, 34, 84). An optical system includes at least one lens (18, 38, 88) in optical communication with the LED module (16, 36, 86). A zoom apparatus (20, 40, 90) selectively adjusts the relative axial separation of the optical system and the LED module (16, 36, 86). In one embodiment (30), the zoom apparatus (40) is slidably adjustable. In a another embodiment (80), the zoom apparatus (90) is rotatably adjustable.

11 Claims, 11 Drawing Sheets

ZOOMABLE SPOT MODULE

BACKGROUND OF INVENTION

1. Field of the Invention

The invention relates to the lighting arts. It is especially applicable to the packaging of light emitting diodes (LED's) to form a spot light, flashlight, or other lamp type that produces a collimated or partially collimated beam, and will be described with particular reference thereto. However, the invention will also find application in packaging of LED's, semiconductor lasers, halogen bulbs, and other light emitting elements for spot lighting, flood lighting, and other optical applications.

2. Discussion of the Art

Spot light lamps emit a collimated or partially collimated beam of light (e.g., a conical beam), and are employed in room lighting, hand-held flashlights, theater spot lighting, and other applications. Examples of such lamps include the MR-series halogen spotlights which incorporate an essentially non-directional halogen light bulb arranged within a directional reflector, such as a parabolic reflector. The MR-series halogen spotlights are commercially available with or without a front lens, and typically include electrical connectors disposed behind the parabolic reflector, i.e., outside of the range of the directed beam. The reflector, optionally in cooperation with a front lens, effectuates collimation of the halogen light bulb output to produce the collimated or conical light beam. The MR-series spotlights are available in a range of sizes, wattages, color temperatures, and beam angles. However, the MR-series spot ights do not include adjustable beams.

The Maglite® flashlight is a prior art device that has an adjustable spot beam. An incandescent light bulb is arranged inside an essentially parabolic reflector. This device effectuates a variable beam angle ranging from a narrow spot beam to a wide, "flood" beam, by including a rotating actuator for moving the reflector axially with respect to the incandescent bulb. This arrangement suffers from significant beam non-uniformity when the light source is strongly defocused. Under conditions of extreme defocusing, the Maglite® flashlight beam exhibits a black spot at the beam's center.

Lamps which utilize one or more LED's as the source of light are becoming more attractive as the light output intensities of commercial LED's steadily increase over time due to design, materials, and manufacturing improvements. Advantageously for spot module applications, commercial LED's typically have a lensing effect produced by the epoxy encapsulant that is usually employed to seal the LED chip from the environment. Hence, these commercial LED's are already somewhat directional, and this directionality can be enhanced using an external lens. Additionally, LED's that emit white light of reasonably high spectral quality are now available. In spite of continuing improvements in LED light output, at present an individual LED is typically insufficiently bright for most lighting applications. Nonetheless, due to the small size of LED's, this intensity limitation can be obviated through the use of a plurality of closely packed LED's that cooperate to produce sufficient light.

Application of LED's to spotlighting applications, and especially to spotlighting applications in which the LED-based lamp is contemplated as a retrofit for replacing an existing lamp that employs another lighting technology (e.g., a retrofit for replacing an MR-series halogen lamp) is complicated by the use of multiple LED's as the light source. The spatially distributed nature of an LED source array greatly reduces the effectiveness of conventional parabolic reflectors which are designed to collimate and direct light emanating from a point source, such as light generated by a halogen or incandescent bulb filament. Furthermore, a front lens of the type optionally included in an MR-series halogen spot lamp is ill-suited for collimating light from a plurality of LED's, because most of the LED's are not positioned on the optical axis of the lens. Thus, the optical systems of existing spot lamps, both with and without variable beam angle, are relatively ineffective when used in conjunction with LED light sources.

The present invention contemplates an improved light source or lamp that overcomes the above-mentioned limitations and others.

BRIEF SUMMARY OF INVENTION

In accordance with one embodiment of the present invention, a lamp is disclosed. An LED module includes at least one LED arranged on a substrate. An optical system includes at least one lens in optical communication with the LED module. A zoom apparatus selectively adjusts the relative axial separation of the optical system and the LED module.

In accordance with another embodiment of the present invention, a lamp is disclosed. An LED module includes a plurality of LED's for generating a lamp beam. An adaptive optical system selectively adjusts the angular spread of the lamp beam.

In accordance with yet another embodiment of the present invention, a lamp is disclosed. A light source optically interacts with an optical system having at least one lens in optical communication with the light source. A zoom apparatus selectively adjusts the relative axial separation of the optical system and the light source.

Numerous advantages and benefits of the present invention will become apparent to those of ordinary skill in the art upon reading and understanding the following detailed description.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE INVENTION

Figure 1:
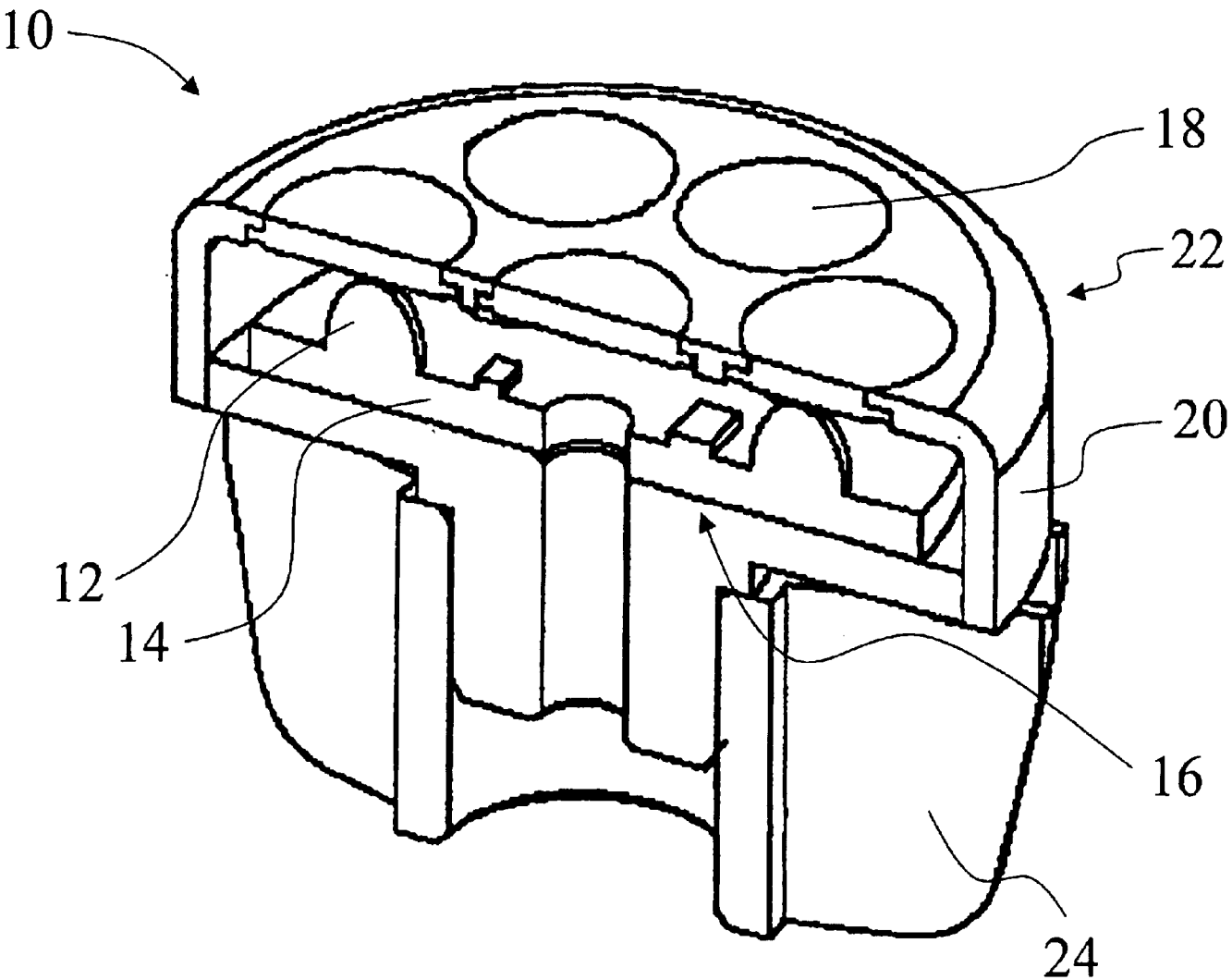
FIG. 1 shows an isometric view of a zoomable spot lamp that suitably practices an embodiment of the invention.

With reference to FIG. 1, a lamp that suitably practices an embodiment of the invention is described. A lamp or light source 10 includes a plurality of light emitting diodes (LED's) 12 arranged on a base or substrate 14, the combination of which forms an LED module 16. A plurality of lenses 18 are arranged in conjunction with the LED's 12, such that each LED 12 lies on the optical axis of one of the lenses 18. The lenses 18 effectuate a collimation of the light emitted by the LED's 12, so that the lamp output is a collimated or conical beam having a desired angle of divergence. Preferably, the LED's 12 are positioned closely to the lenses 18 to maximize the light captured. For this reason, the lenses 18 should be fast lenses, i.e., should have a low f number. These preferred lens optical properties are not readily obtainable using conventional lenses. Accordingly, fresnel lenses are advantageously used for the lenses 18 to provide very low f number behavior in a reasonably sized lens.

In the illustrated embodiment of FIG. 1, there is a one-to-one correspondence between lenses 18 and LED's 12. That is, each LED 12 is associated with a single lens 18. This in turn allows each LED 12 to lie on the optical axis of its corresponding lens 18, which maximizes the optical efficiency of the combination. In other words, the spatial pattern of the lenses 18 corresponds with the spatial pattern of the LED's 12.

The lenses 18 are arranged on a zoom apparatus 20 which together with the lenses form an adaptive optical system 22. The optical system 22 is relatively adjustable with respect the LED module 16 to enable a selectable distance separation along the optical axis between the lenses 18 and the LED's 12.

Because the lamp 10 is intended for lighting applications, the LED's 12 preferably emit light at high intensities. This entails electrically driving the LED's 12 at relatively high currents, e.g., as high as a few hundred milliamperes per LED 12. Because LED light emission is very temperature-sensitive, the heat dissipated in the LED's 12 as a consequence of the high driving currents is advantageously removed by a heat sink 24 which is thermally connected with the substrate 14.

Figure 2:
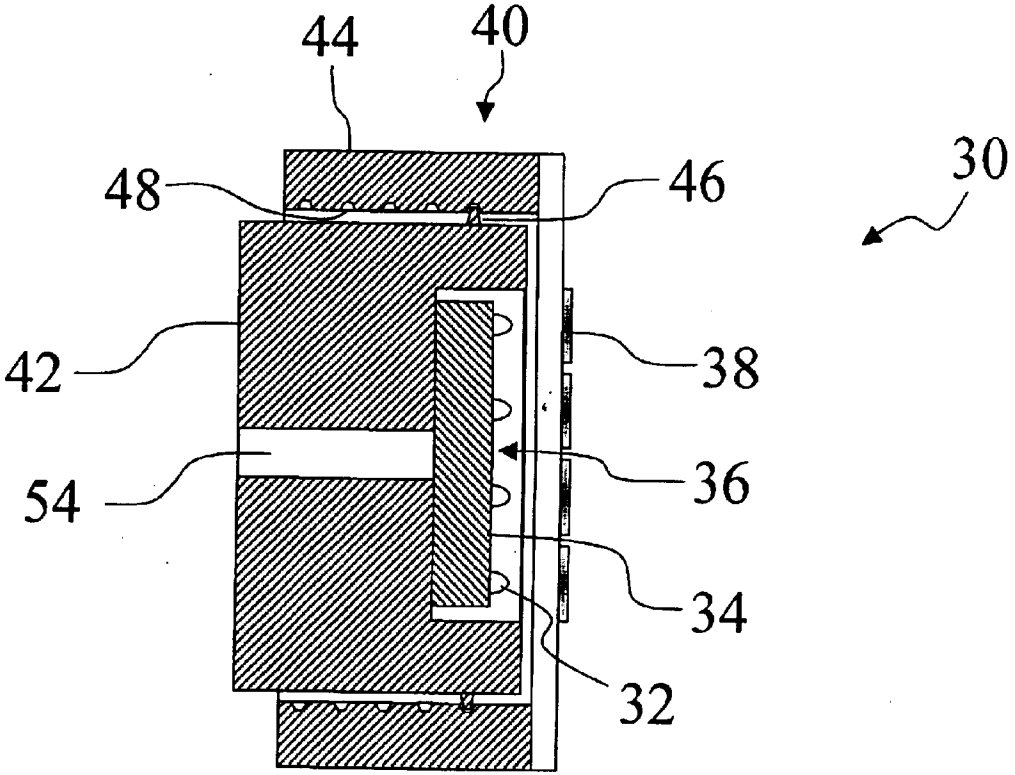
FIG. 2 shows a schematic cross-sectional view of a zoomable spot lamp that suitably practices an embodiment of the invention, the lamp being shown as adjusted to produce a wide-angle flood beam.
Figure 3:
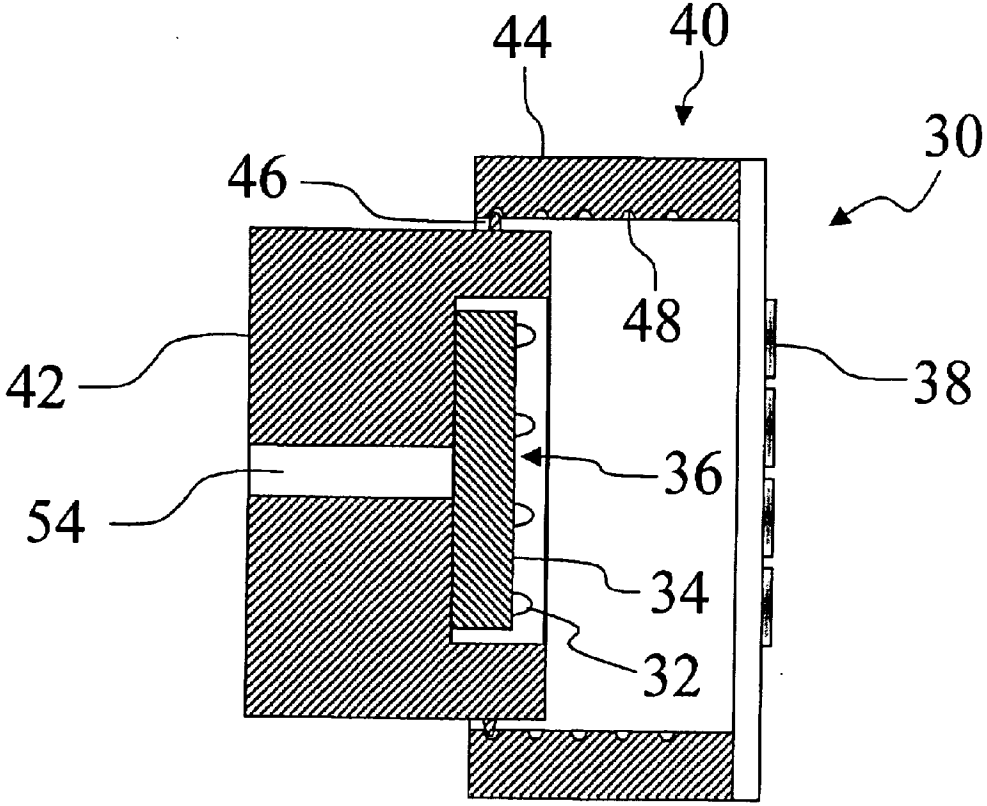
FIG. 3 shows a schematic cross-sectional view of the lamp of FIG. 2, adjusted to produce a narrow-angle spot beam.
Figure 4:
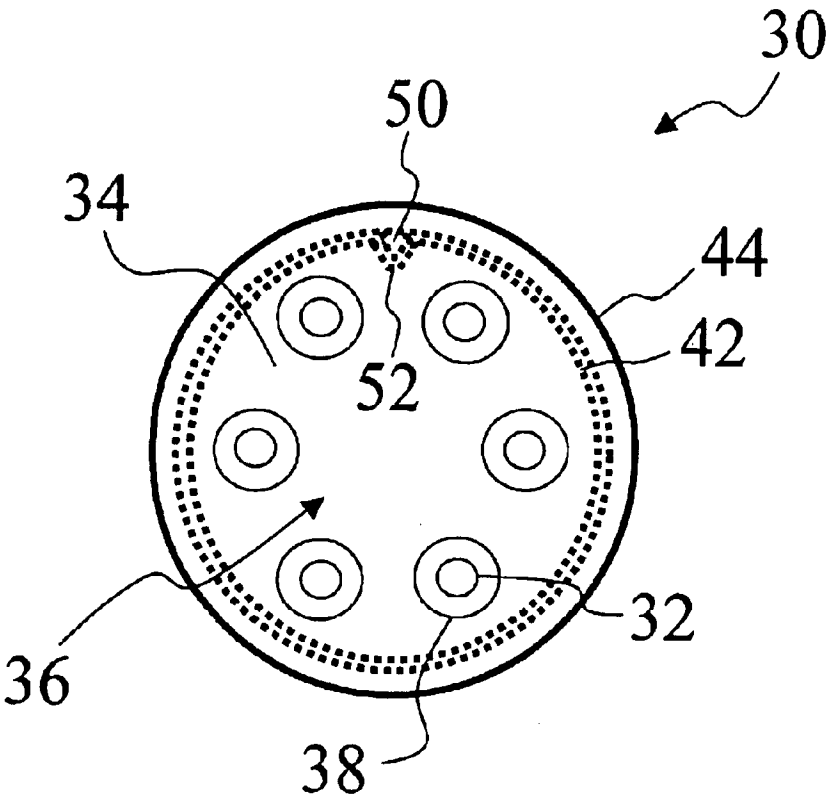
FIG. 4 shows a front view of the lamp of FIG. 2, looking directly into the beam, with dotted lines indicating the hidden sleeves of the zoom apparatus and the interlocking mechanism.

With reference now to FIGS. 2 through 4, a lamp 30 that suitably practices an embodiment of the invention in which the zoom apparatus operates on a mechanical sliding principle is described. LED's 32 are arranged on a substrate 34 forming an LED module 36. A plurality of lenses 38, which are preferably Fresnel lenses, are arranged in correspondence with the LED's 32, with each LED 32 lying on the optical axis of an associated lens 38. A sliding zoom apparatus 40 includes two slidably interconnecting elements or sleeves 42, 44. The LED module 36 is arranged on or in the first sleeve 42 in a fixed manner. The lenses 38 are arranged on or in the second sleeve 44, also in a fixed manner. It will be appreciated that zoom apparatus 40 of the lamp 30 effectuates beam width adjustment through the relative motion of the sleeves 42, 44.

The configuration of the zoom apparatus 40 shown in FIG. 2 corresponds to a minimum relative separation between the LED's 32 and the lenses 38. This configuration produces a wide beam, i.e., a conical beam with a wide angle of divergence, sometimes called a flood light.

The configuration of the zoom apparatus 40 shown in FIG. 3 corresponds to a maximum relative separation between the LED's 32 and the lenses 38. This configuration produces a narrow beam, i.e., a conical beam with a small angle of divergence, sometimes called a spotlight.

A sliding zoom apparatus can optionally effectuate continuous zoom adjustment (not shown). For continuous zoom adjustment, the sleeves should be of sufficiently close relative tolerances so that the frictional force between the two sleeves 42, 44 inhibits unintended sliding slippage therebetween.

Alternatively, as shown in the illustrated embodiment of FIGS. 2 and 3, the zoom apparatus 40 is an indexed zoom apparatus. A projection or stop 46, which can be a single projection, a plurality of projections, or an annular projection, extends from the first sleeve 42 and is selectably moved into one of five recesses or stop positions 48, which can be annular grooves, holes, or the like. The projection(s) 46 and the recesses 48 are mutually adapted to enable relative movement of the sleeves 42, 44 to selectably move the stop 46 to a selected stop position 48. The projections or stop 46 and the recesses or stop positions 48 cooperate to bias the zoom apparatus into certain pre-selected axial spacings or stop positions. It will be appreciated that such an index system tends to reduce slippage between the two sleeves 42, 44 versus a similar continuous zoom adjustment which relies upon frictional force to prevent slippage. Of course, the index system of FIGS. 2 and 3 is exemplary only, and many variations thereof are contemplated, such as placing the stop onto the first sleeve and the recesses onto the second sleeve, using other than five stop positions, etc.

With reference to FIG. 4, in addition to the zoom indexing system exemplarily effectuated by projection(s) 46 and recesses 48, the lamp 30 also includes an advantageous interlocking mechanism including a linear projection 50 aligned along the sliding direction of the sliding zoom apparatus 40 and extending inwardly from the second sleeve 44 toward the first sleeve 42, and a corresponding linear depression 52 that receives the linear projection 50. This interlocking mechanism prevents relative rotation between the first and second sleeves 42, 44 so that the LED's 32 are maintained centered on the optical axes of the lenses 38.

With reference to FIGS. 2 and 3, the lamp 30 also includes one or more electrical conduits 54 through which wires or other electrical conductors (not shown) connect the LED's to an associated power supply (not shown). Although an exemplary single conduit 54 is shown, numerous variations are contemplated, such as separate conduits for each LED 32.

In addition, electrical components such as a printed circuit board that electrically connects the LED's 32 and has optional driving electronics operatively arranged thereupon, metallized connections, an associated battery or other electrical power supply, etc., are also contemplated (components not shown). It will be recognized that such electrical components are well known to those skilled in the art.

Figure 5:
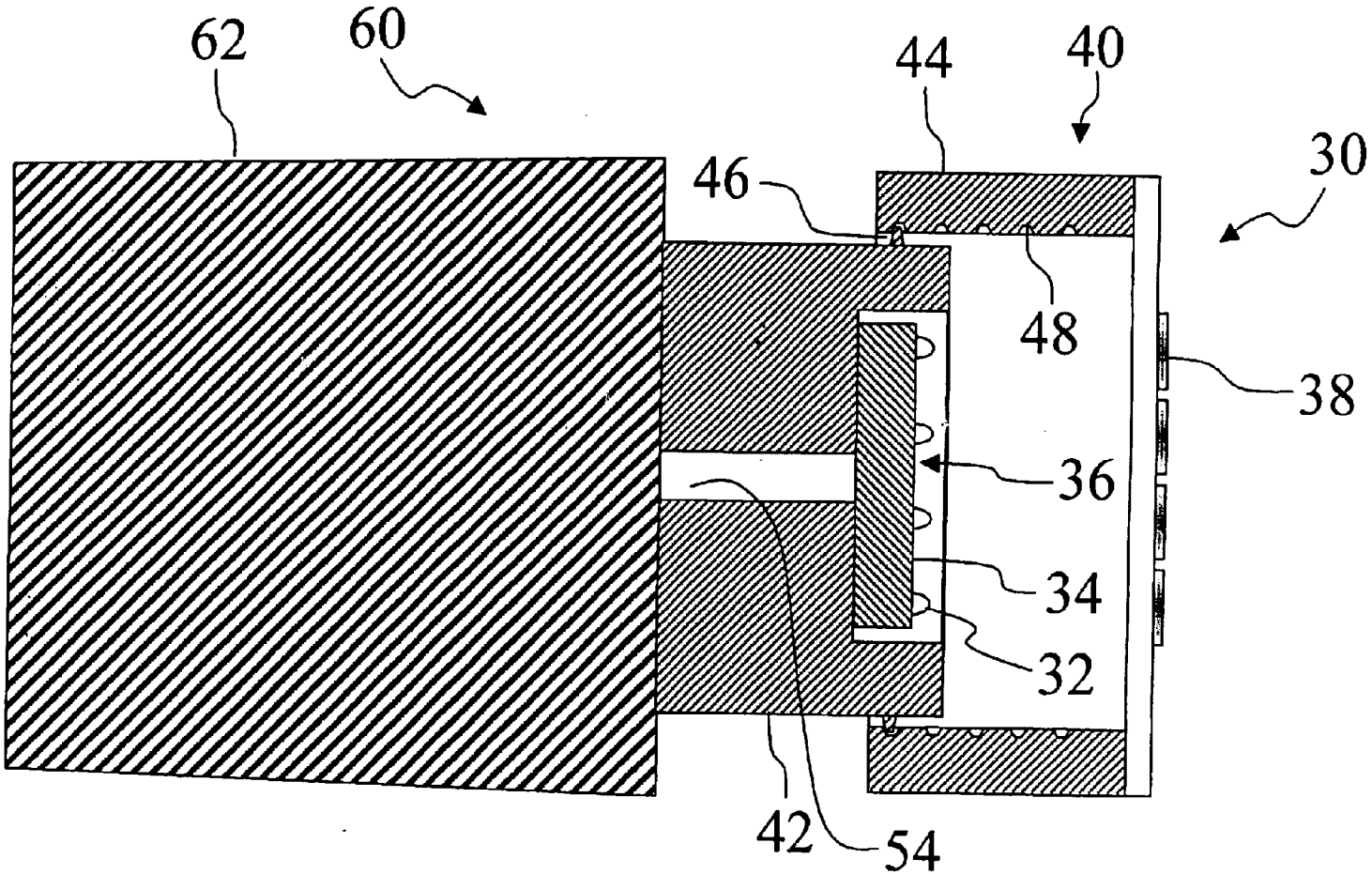
FIG. 5 shows a schematic cross-sectional view of the lamp of FIG. 2 in a first mounting configuration.

With reference to FIG. 5, a mounting configuration 60 for the lamp 30 of FIGS. 2 through 4 is described. In the mounting configuration 60, the inner sleeve 42 remains fixed relative to a mounting element 62, while the sliding movement of the outer sleeve 44 effectuates the zoom adjustment. The mounting element 62 could, for example, be the approximately cylindrical body of a hand flashlight that contains associated batteries to power the lamp 30, in which case movement of the outer sleeve 44 is effectuated manually by the user. Alternatively, for a theater stage spotlight mounting configuration, the movement of sleeve 44 could be mechanized. It will be appreciated that the mounting configuration 60 is rather simple to construct because the adjustable outer sleeve 44 is accessible.

Figure 6:
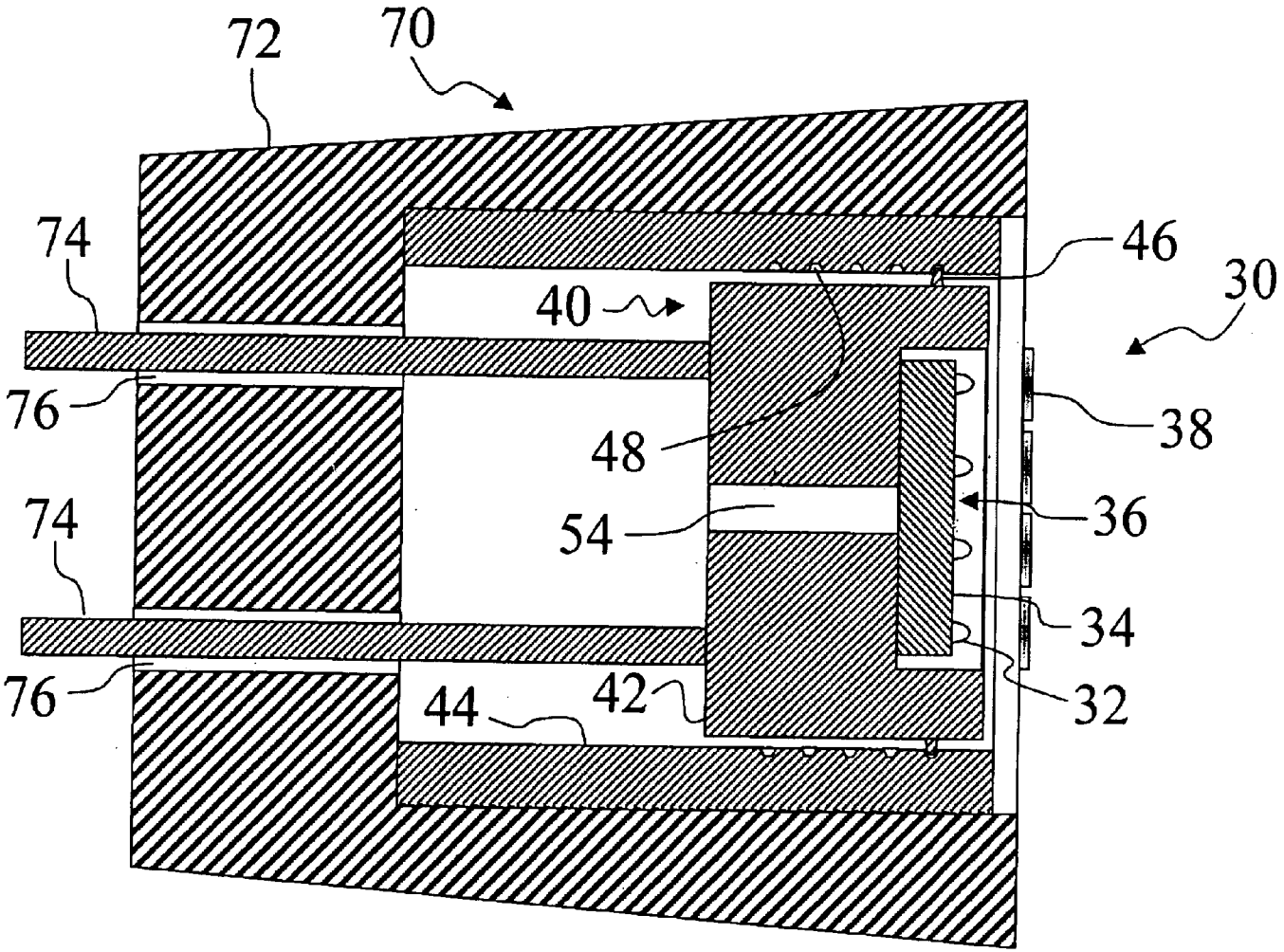
FIG. 6 shows a schematic cross-sectional view of the lamp of FIG. 2 in a second mounting configuration.

With reference to FIG. 6, another mounting configuration 70 for the lamp 30 of FIGS. 2 through 4 is described. In the mounting configuration 70, the outer sleeve 44 remains fixed relative to a mounting element 72, while movement of the inner sleeve 42 effectuates the zoom adjustment. In this case, the inner sleeve 42 is relatively inaccessible from outside the mounting configuration 70, and so in the embodiment of FIG. 6 one or more posts 74 are rigidly affixed to the inner sleeve 42 and pass through passthroughs 76 in the mounting element 72 to provide handles or shafts by which the inner sleeve 42 is slidably adjusted to effectuate the zoom. The mounting configuration 70 is therefore more complex versus the mounting configuration 60 of FIG. 5. However, the mounting configuration 70 has the advantage of fully containing the lamp 30 within the mounting element 72 so that a lighting device that employs the configuration 70 has definite and fixed outside dimensions. The one or more posts 74 are also easily adapted to connect with a motor (not shown) to effectuate a mechanized zoom adjustment.

Figure 7:
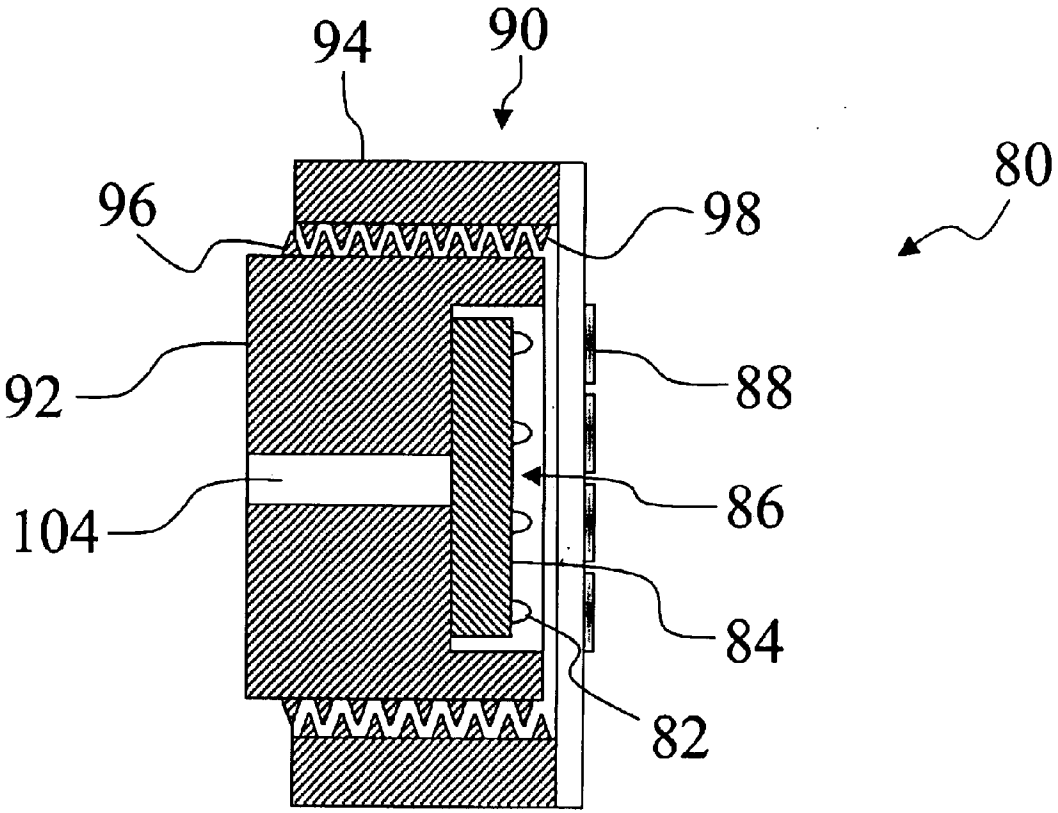
FIG. 7 shows a schematic cross-sectional view of a zoomable spot lamp that suitably practices another embodiment of the invention, the lamp being shown as adjusted to produce a wide-angle flood beam.

With reference to FIG. 7, a lamp 80 that suitably practices another embodiment of the invention in which the zoom apparatus operates on a mechanical rotation principle is described. LED's 82 are arranged on a substrate 84 forming an LED module 86. A plurality of lenses 88, which are preferably Fresnel lenses, are arranged in the same pattern as the LED's 82. The rotating zoom apparatus 90 includes two threadedly interconnecting elements or sleeves 92, 94. The LED module 86 is arranged on or in the first sleeve 92 in a fixed manner. The lenses 88 are arranged on or in the second sleeve 94, also in a fixed manner. Thus, by relatively screwing the first and second sleeves 92, 94 into or out of each other using the cooperating threads 96, 98 disposed on the outside of the first sleeve 92 and the inside of the second sleeve 94, respectively, the relative axial separation of the LED's 82 and the lenses 88 is adjusted. The first sleeve 92 preferably includes one or more electrical conduits 104 which are analogous to the conduit or conduits 54 of the embodiment of FIG. 2.

Figure 8A:
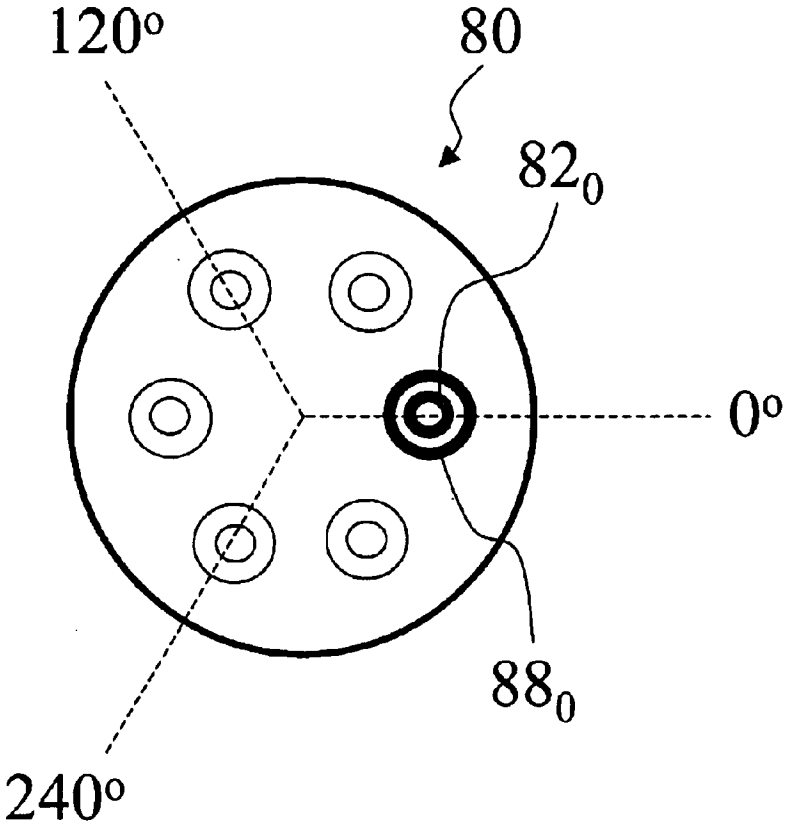
FIG. 8A shows a front view of the lamp of FIG. 7, looking directly into the beam, with the zoom apparatus rotated at a reference position, herein designated as 0°, between the first and second sleeves.

Although the LED's 82 and the lenses 88 are arranged in the same spatial pattern, it will be recognized that the rotating motion in general results in a misalignment of the LED's 82 off the optical axes of the lenses 88. However, for certain relative rotational orientations of the sleeves 92, 94, the two patterns align, as shown in FIG. 8A. The relative rotational orientation shown in FIG. 8A is herein designated as 0° and serves as a reference orientation. Furthermore, a specific LED $\mathbf{82}_0$, and a specific lens $\mathbf{88}_0$, are shown in bold in FIG. 8A and will be tracked during zoom adjustment using FIGS. 8B and 8C in the discussion which follows.

Figure 8B:
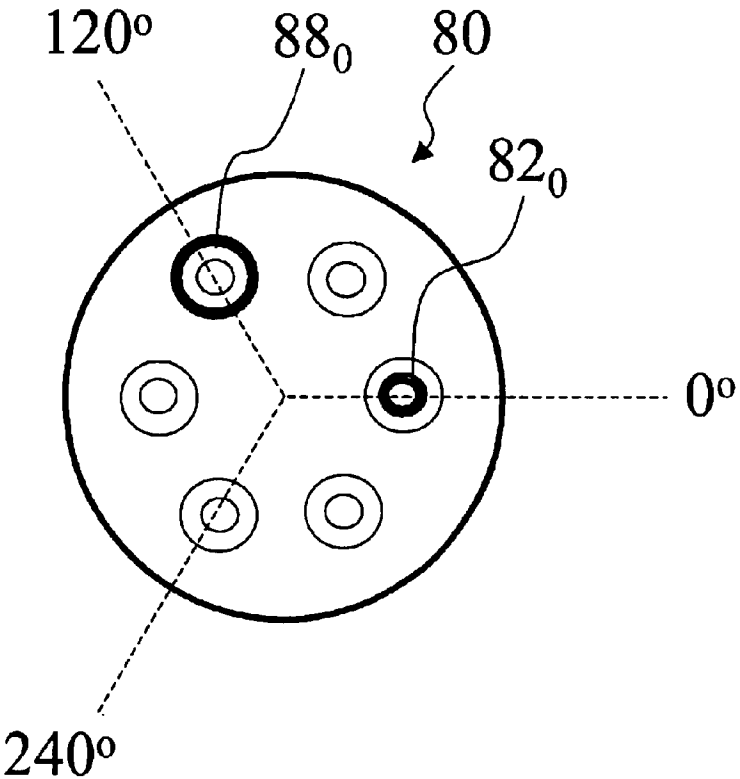
FIG. 8B shows a front view of the lamp of FIG. 7, looking directly into the beam, with the second sleeve rotated 120° compared with its reference orientation of FIG. 8A.

With reference to FIG. 8B, the reference orientation has been changed by rotating the second sleeve 94 counter-clockwise by 120°. Two changes result from the 120° rotation. First, the axial separation of the LED's 82 and the lenses 88 changes by an amount related to the spacing of the threads 96, 98 due to the screwing action. Second, the lens $\mathbf{88}_0$ is no longer axially aligned with the LED $\mathbf{82}_0$, but rather now axially aligns with another LED as seen in FIG. 8B.

Figure 8C:
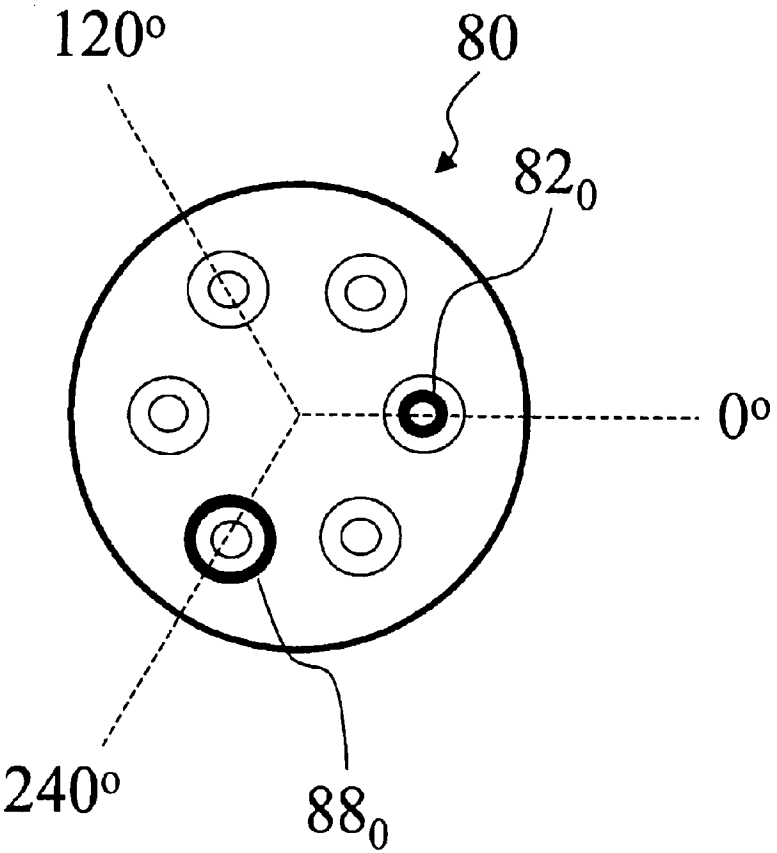
FIG. 8C shows a front view of the lamp of FIG. 7, looking directly into the beam, with the second sleeve rotated 240° compared with its reference orientation of FIG. 8A.

With reference to FIG. 8C, the second sleeve 94 has been rotated counter-clockwise by another 120° (240° total rotation versus FIG. 8A). The axial separation of the LED's 82 and the lenses 88 is again changed by an amount related to the spacing of the threads 96, 98, and the lens $\mathbf{88}_0$ axially aligns with yet another LED as seen in FIG. 8C. Although not illustrated as a separate figure, it will be recognized that a third counter-clockwise rotation of 120° would bring the total rotation versus FIG. 8A up to 360°, i.e. one complete rotation, and would reproduce the pattern alignment shown in FIG. 8A, but with a change in axial spacing between the LED's 82 and the lenses 88 corresponding to the spacing of the threads 96, 98.

In one aspect of the embodiment, the threads 96, 98 have thread joints, indented stops or another mechanism (not shown) to bias the zoom apparatus 90 into indexed positions such as those shown in FIGS. 8A, 8B, and 8C wherein the lens 88 pattern aligns with the LED 82 pattern. It will be recognized that if the lens 88 pattern and the LED 82 pattern each have an n-fold rotational symmetry, then separation of the rotational stop positions by integer multiples of 360°/n enables stop positions for which each LED 82 is axially aligned with one of the plurality of lenses 88. In the exemplary embodiment shown in FIGS. 8A, 8B and 8C, the patterns have six-fold rotational symmetry (n=6), and the stop positions are separated by 2×(360°/n)=120° rotations.

In another aspect of the embodiment, the rotation of the zoom apparatus 90 can also be continuous with no index biasing. In this case the frictional interaction between the threads 96, 98 should be sufficient to counteract slippage of the zoom apparatus 90.

Figure 8D:
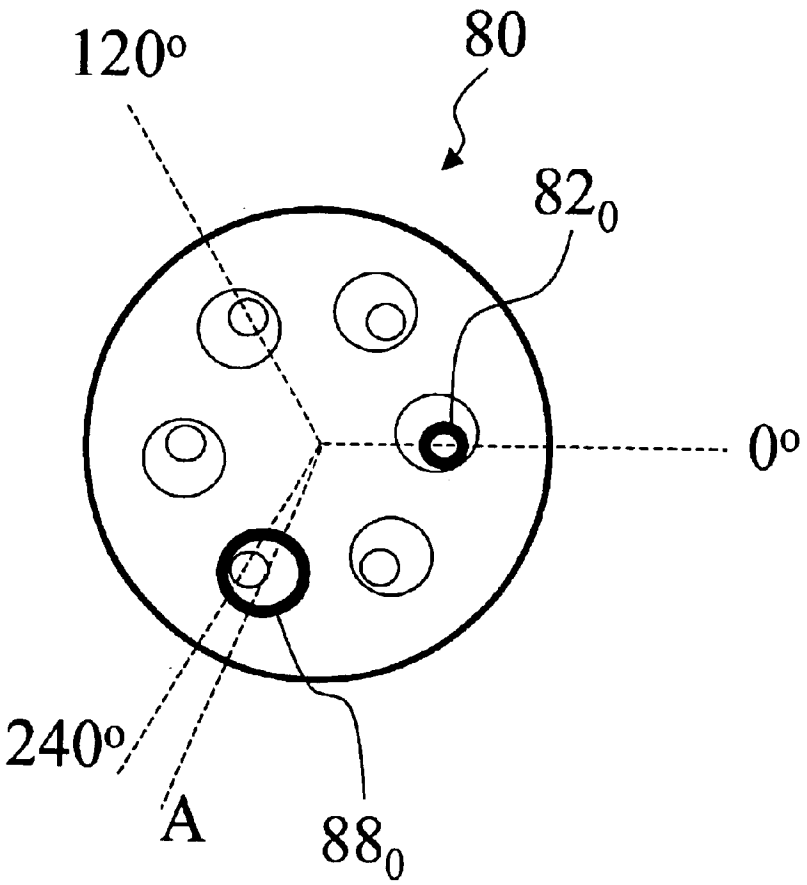
FIG. 8D shows a front view of the lamp of FIG. 7, looking directly into the beam, with the second sleeve rotated slightly more than 240° compared with its reference orientation of FIG. 8A.

FIG. 8D shows a relative rotational orientation of the LED 82 pattern and the lenses 88 pattern wherein the LED's 82 are not axially aligned with the lenses 88, but rather are relatively positioned slightly off-axis. It will be recognized that a relative pattern orientation such as that shown in FIG. 8D can be obtained either with or without index biasing. Such a slightly off-axis relative orientation produces defocusing which can provide further freedom for adjusting the light beam properties. In FIG. 8D, the second sleeve 94 has been rotated to an angle A relative to the reference rotational orientation of FIG. 8A, where the angle A is slightly greater than the 240° orientation that would produce pattern alignment.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. A lamp comprising:

an LED module including a plurality of LEDs arranged in a first pattern on a substrate;

an optical system including a plurality of lenses in optical communication with the LED module;

a zoom apparatus that selectively relatively axially translates the optical system and the LED module, the zoom apparatus including:

an inner sleeve on which the LED module is disposed, and an outer sleeve on which the zoom apparatus is disposed, the inner and outer sleeves being slidably interconnected with the inner sleeve disposed inside the outer sleeve.

2. The lamp as set forth in claim 1, wherein the plurality of lenses comprises:

a plurality of Fresnel lens arranged in a second pattern that corresponds with the first pattern.

3. The lamp as set forth in claim 1, wherein the plurality of lenses remain optically aligned with the LEDs of the LED module during relative axial translation of the optical system and the LED module.

4. A lamp comprising:

an LED module including at least one LED arranged on a rigid substrate;

an optical system including at least one lens in optical communication with the LED module; and a zoom apparatus that selectively adjusts the relative axial separation of the optical system and the LED module, the zoom apparatus including:

a first sleeve having the LED module rigidly arranged thereon, the first sleeve further having a first threading arranged thereon; and a second sleeve having a second threading arranged thereon that is adapted to cooperate with the first threading such that the first sleeve and the second sleeve are relatively movable in a screwing fashion, the second sleeve further having the optical system rigidly arranged thereon.

5. The lamp as set forth in claim 4, further comprising:

an index system that relatively biases the first sleeve and the second sleeve into a selected one of a plurality of selectable relative rotational positions.

6. The lamp as set forth in claim 1, wherein the zoom apparatus further comprises:

a mechanical interlock between the inner and outer sleeves that prevents relative rotation therebetween.

7. A lamp comprising:

an LED module including at least one LED arranged on a substrate;

an optical system including at least one lens in optical communication with the LED module; and a zoom apparatus that selectively adjusts the relative axial separation of the optical system and the LED module, the zoom apparatus including a first sleeve having the LED module disposed thereon and a second sleeve having the optical system disposed thereon, the second sleeve slidingly connected with the first sleeve, the zoom apparatus further including a mechanical interlock between the first and the second sleeves that prevents relative rotation therebetween, the mechanical interlock including;

a protrusion on one of the first and the second sleeves, the protrusion being aligned parallel to the optical axis, and a groove on one of the first and the second sleeves that receives the protrusion to prevent relative rotation of the first and the second sleeves.

8. The lamp as set forth in claim 1, further comprising:

a stop that relatively biases the inner and outer sleeves into one or more selectable relative axial stop positions.

9. A lamp comprising:

a plurality of light sources;

an optical system including a plurality of lenses in optical communication with the light sources; and a zoom apparatus that selectively adjusts a relative axial separation of the optical system and the light sources, the zoom apparatus including two threadedly interconnected sleeves, the first sleeve having the light sources arranged thereon, and the second sleeve having the optical system arranged thereon.

10. The lamp as set forth in claim 9, wherein the light sources are rigidly mounted on the first sleeve and the optical system is rigidly mounted on the second sleeve.

11. The lamp as set forth in claim 1, wherein the outer sleeve defines fixed outside dimensions of the zoom apparatus.

* * * * *